US005369839A

United States Patent [19]

Wörwag

[11] Patent Number: 5,369,839

[45] Date of Patent: Dec. 6, 1994

[54] VACUUM CLEANER

[75] Inventor: Peter Wörwag, Romanshorn, Switzerland

[73] Assignee: Firma Fedag, Romanshorn, Germany

[21] Appl. No.: 23,848

[22] Filed: Feb. 26, 1993

[30] Foreign Application Priority Data

Feb. 28, 1992 [DE] Germany ..... 4206188

[51] Int. Cl.[5] ..... A47L 5/36

[52] U.S. Cl. ..... 15/327.6; 15/352; 15/353

[58] Field of Search ..... 15/327.1, 327.6, 352, 15/353

[56] References Cited

U.S. PATENT DOCUMENTS

| | | | |
|---|---|---|---|
| 2,673,619 | 3/1954 | Martin | 15/353 X |
| 2,731,103 | 1/1956 | Ortega | 15/353 X |
| 3,286,446 | 11/1966 | Happe et al. . | |
| 3,971,096 | 7/1976 | Renholt | 15/353 X |
| 4,275,731 | 6/1981 | Nichols | 15/353 X |
| 4,533,371 | 8/1985 | Nakamura | 15/347 X |
| 4,953,255 | 9/1990 | Jenkins | 15/352 X |

FOREIGN PATENT DOCUMENTS 623781 7/1929 France .

2351769 10/1973 Germany .

*Primary Examiner*—Chris K. Moore

*Attorney, Agent, or Firm*—Robert W. Becker & Associates

[57] ABSTRACT

A vacuum cleaner includes a receptacle having an outer wall and a suction socket. A cover for closing the receptacle is provided. The cover contains the drive motor and a suction fan that produces an air stream that is guided via the suction socket into the receptacle and removed from the receptacle. A suction chamber with a chamber wall is provided between the suction fan and the receptacle and extends substantially over the entire cross-section of the receptacle. The chamber wall of the suction chamber has a plurality of inlets in close proximity to the outer wall of the receptacle. The inlets open into the receptacle and are arranged next to one another in a circumferential direction of the receptacle such that the inlets form an annular air inlet. The suction socket has an inlet channel that is spaced at a distance relative to a central longitudinal axis of the vacuum cleaner. The inlet channel penetrates the suction chamber and extends into the receptacle substantially parallel to the central longitudinal axis. The inlet channel has an outlet facing the central longitudinal axis.

20 Claims, 14 Drawing Sheets

VACUUM CLEANER

BACKGROUND OF THE INVENTION

The present invention relates to a vacuum cleaner comprising a drive motor and a suction fan in which the suction air flow is guided via a suction socket into a receptacle, which is closed by a cover containing the drive motor and the suction fan, and wherein the suction fan sucks air out of the receptacle.

Such a commercial vacuum cleaner is known from German Offenlegungsschrift 23 51 769 and has an angular suction socket radially extending from the receptacle and opening axially into the receptacle containing a dust filter. The dust filter is designed to retain dirt that is transported within the suction air flow. The suction opening of the suction fan that generates the suction air stream is arranged above the dust filter in the cover and sucks the air out of the receptacle. Due to the arrangement of the suction socket a main flow from the suction socket through the filter to the suction opening of the suction fan results. Besides this main flow an auxiliary flow with substantially reduced flow velocities is also formed. In areas protected by the filter bag extremely flow-reduced areas are present.

The dirt particles within the main flow hit with high kinetic energy the filter wall and can even partially penetrate the filter wall. Thus, the filtering effect can be substantially reduced so that the outblowing air stream is greatly laden with dirt. Furthermore, since essentially only the directly accessible areas of the filter are used and after their saturation the filter effect is diminished, a filter bag must be exchanged prematurely even though parts of the filter lying in the flow-protected areas are still effective.

In order to provide for a uniform flow through the filter, it has been suggested in U.S. Pat. No. 3,286,446 and French patent 623,781 to suck the suction air flow via a comb-shaped suction head from the receptacle, whereby the walls of the suction head are provided with a plurality of inlet flow openings. The arrangement of the suction socket is such that the entering suction air stream flows without any further deflection into the suction head, so that dirt particles hit the filter at high kinetic energies and can damage the filter.

It is therefore an object of the present invention to provide a vacuum cleaner of the aforementioned kind with which a uniform usage of the dust-retaining filter with a minimal pollution of the exit air is ensured.

BRIEF DESCRIPTION OF THE DRAWINGS

The object, and other objects and advantages of the present invention, will become more apparent from the following specification in conjunction with the accompanying drawings, in which.

SUMMARY OF THE INVENTION

Figure 1:
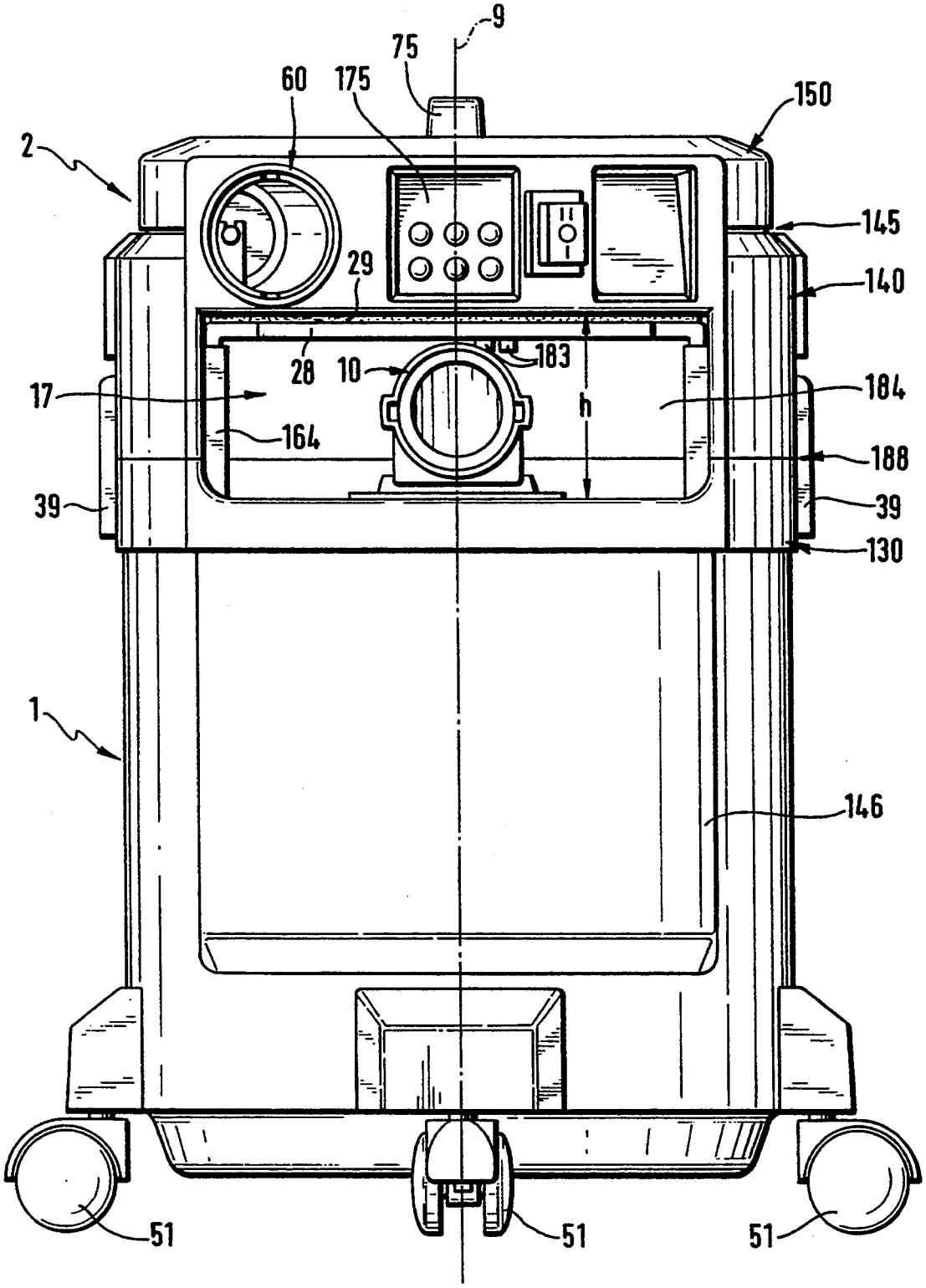
FIG. 1 is a front view of the inventive vacuum cleaner.

The inventive vacuum cleaner is primarily characterized by:

A receptacle having an outer wall;

A cover, for closing the receptacle, having a suction socket;

A drive motor connected within the cover;

A suction fan, producing an air stream that is guided via the suction socket into the receptacle and removed from the receptacle, connected within the cover;

A suction chamber with a chamber wall, the suction chamber connected between the suction fan and the receptacle and extending substantially over an entire cross-section of the receptacle;

The chamber wall of the suction chamber having a plurality of inlets in close proximity to the outer wall of the receptacle, the inlets opening into the receptacle and arranged next to one another in a circumferential direction of the receptacle such that the inlets form an annular air inlet;

The suction socket having an inlet channel;

The inlet channel spaced at a distance relative to a central longitudinal axis of the vacuum cleaner;

The inlet channel penetrating the suction chamber and extending into the receptacle substantially parallel to the central longitudinal axis; and The inlet channel having an outlet facing the central longitudinal axis.

Since the suction opening of the suction fan opens into the suction chamber, which is connected via the annular air inlet, respectively, the inlets arranged next to one another in the circumferential direction of the receptacle to the receptacle, a uniform suction air stream is generated over the periphery of the receptacle toward the cover so that the air stream entering via the suction socket is diffusely removed over a great area of the filter bag. The bell-shaped arrangement of the air flow toward the suction chamber ensures a substantially uniform flow through the filter bag over the entire circumference of the receptacle so that a high usage of the available filter surfaces results. Thus, the exit stream is substantially free of dirt particles. The constructive design and arrangement of the air inlet channel together with the diffuse air removal ensures that the dirt particles entering through the suction socket at high energy levels are deflected whereby kinetic energy is released so that the impact velocity on the wall of the filter back is reduced. The imminent danger of partial penetration of the filter by dirt particles is thus reduced so that over an extending service life the exit air flow is substantially free of coarse dirt particles.

In a preferred embodiment, the outlet is slightly slanted relative to the central longitudinal axis. Advantageously, the cover comprises a bottom plate and an intermediate plate, with the suction chamber being formed between the bottom plate and the intermediate plate. Preferably, the bottom plate is cup-shaped and has an upper, radially outwardly oriented ring, the upper radially outwardly oriented ring having the aforementioned inlets.

The vacuum cleaner preferably further comprises a radially outwardly open passage with a bottom, wherein the intermediate plate forms the bottom of the passage and wherein the suction socket further comprises an angular piece movably connected within the passage, the angular piece connected to the inlet channel. Advantageously, the passage opens radially outwardly and extends in a circumferential direction of the vacuum cleaner at a segment angle of substantially 90°.

Expediently, the inlet channel and the intermediate plate are a single unitary part, and the inlet channel penetrates the bottom plate in an air-tight manner.

Advantageously, the vacuum cleaner further comprises:

A through-flow chamber and a support ring for a filter, the support ring resting in the receptacle, with the through-flow chamber positioned between the bottom plate and the support ring;

A grate with a filter mat, the grate supported on the support ring, and the grate and the filter mat penetrated by the inlet channel; and A fastening device for an inner dust filter bag, the inlet channel extending into the dust filter bag, the fastening device connected to a side of the grate facing the receptacle. Advantageously, a support cylinder is supported on the support ring and an end of the support cylinder facing the cover is closed. In a further embodiment of the present invention, a cover plate supported on the support ring is provided, the inlet channel penetrating the cover plate in an air-tight manner. Furthermore, a dust filter supported by the cover plate is provided. The dust filter preferably is in the form of an accordion fold.

The inventive vacuum cleaner, in another embodiment, further comprises an outer cylindrical folded filter with upright folds, the folded filter supported by the support ring. Furthermore, an outer filter bag may be provided which is supported by the support ring and which encloses the folded filter.

In order to achieve a high degree of dirt particle retention it is suggested that between the bottom plate and the receptacle a support ring for the filter is arranged which supports an outer, cylindrical folded filter with preferably upright folding (filter cartridge). A cover plate may be provided on the support ring which is penetrated in an air-tight manner by the inlet channel. The cover plate may support a dust filter, especially an accordion filter, which is thus enclosed by the folded filter. For achieving an especially high degree of dirt particle retention the thus formed double filter may be arranged in a filter bag which may be fastened to the support ring by a pull cord. This triple filter arrangement provides for a very high degree of dust particle retention. Such a vacuum cleaner is especially suitable for rooms with high air quality standards.

In a further embodiment of the present invention the vacuum cleaner has a cover which further comprises a base casing having connected thereto a receiving cylinder. The intermediate plate in this embodiment has a cup-shaped compartment. The suction fan, in its axial direction, has a first end and a second end, the first end being received in the cup-shaped compartment and the second end closing off the receiving cylinder. The intermediate plate and the base casing enclose an air guiding chamber, the air guiding chamber at least partially surrounding the receiving cylinder and communicating with the cup-shaped compartment. The passage is preferably comprised of a sealing wall, arranged as a secant and sealing the passage relative to the air guiding chamber, and to sidewalls extending perpendicular to the sealing wall.

Preferably, the vacuum cleaner further comprises an air calming chamber. The base casing comprises a base plate. The cover further comprises lateral walls and an upper closure plate, the air calming chamber being formed between the base plate, the lateral walls, and the upper closure plate. Advantageously, the base plate has an air inlet opening for connecting the air calming chamber to the air guiding chamber. Preferably, the passage has an outlet grid and the air calming chamber is connected to the outlet grid and open to the atmosphere via the outlet grid.

Thus, in a preferred embodiment of the present invention, the suction fan with one end thereof is supported in a cup-shaped compartment of the intermediate plate whereby the other end of the suction fan closes the receiving cylinder of the base casing. Between the intermediate plate and the base casing an air guiding chamber is formed which at least partially surrounds the receiving cylinder and which communicates with the cup-shaped compartment of the intermediate plate. The air stream of the suction fan is first blown into the air guiding chamber in which the air can expand and partially be calmed. Via an air inlet opening provided at the base plate of the base casing the air stream then enters the air calming chamber which is formed between the base plate of the base casing, the lateral walls and an upper cover plate. The air is further expanded and calmed within the air calming chamber and can then exit via the outlet grid provided at the top of the passage into the atmosphere in a diffused manner. Advantageously, the outlet grid is provided with an exit filter which can optionally retain dirt particles within the exit air stream and thus provide for a high degree of purity of the diffusely exiting air.

The arrangement of the suction chamber, the air guiding chamber, and the air calming chamber in conjunction with the air exiting via the radially open passage minimizes the noise level generated. This noise reduction effect is further enhanced by the fact that the drive motor as well as the suction fan are substantially surrounded by air guiding chambers so that sound waves cannot exit in an undampened manner to the exterior. Of particular importance is, with respect to the longitudinal axis of the vacuum cleaner, the asymmetric arrangement of the drive motor and the suction fan as well as the asymmetric embodiment of the individual air-guiding chambers. Such a design ensures that no standing waves are formed which result in a considerable noise emission.

The vacuum cleaner expediently further comprises a valve chamber positioned above the air inlet opening in the air calming chamber and an air blow socket, connected to the cover and extending radially from the cover. The valve chamber comprises a valve member for directing the air flow alternately to the calming chamber and the air exhaust socket.

Expediently, partitions that are perpendicularly connected to the base plate of the base casing are provided. A cooling air inlet chamber enclosed between the receiving cylinder and the partitions is provided. The cooling air inlet chamber has cooling air inlet slots provided in an outer wall of the base casing. The cooling air exit chamber is enclosed between the base casing and the closure plate. The receiving cylinder has a bottom with a cooling air inlet and a mantle surface with a cooling air outlet. The cooling air flow enters the vacuum cleaner through the cooling air inlet slots, flows through the cooling air inlet into the receiving cylinder for cooling the drive motor, and exits the receiving cylinder through the cooling air outlet into the cooling air exhaust chamber.

Preferably, the passage has a top plate with an outlet grid and the cooling air exit chamber is connected to the outlet grid and opens to the atmosphere via the outlet grid. Expediently, a support for at least one exchangeable filter is provided, the support radially slidable into the passage, wherein the outlet grid connected to the air calming chamber and the outlet grid connected to the cooling air exit chamber are covered by the exchangeable filter. The vacuum cleaner preferably further comprises a double forked light barrier the filter positioned between the light barrier. Furthermore, a control, for switching the drive motor, is connected to the double forked light barrier.

DESCRIPTION OF PREFERRED EMBODIMENTS

The present invention will now be described in detail with the aid of several specific embodiments utilizing FIGS. 1 through 17.

Figure 2:
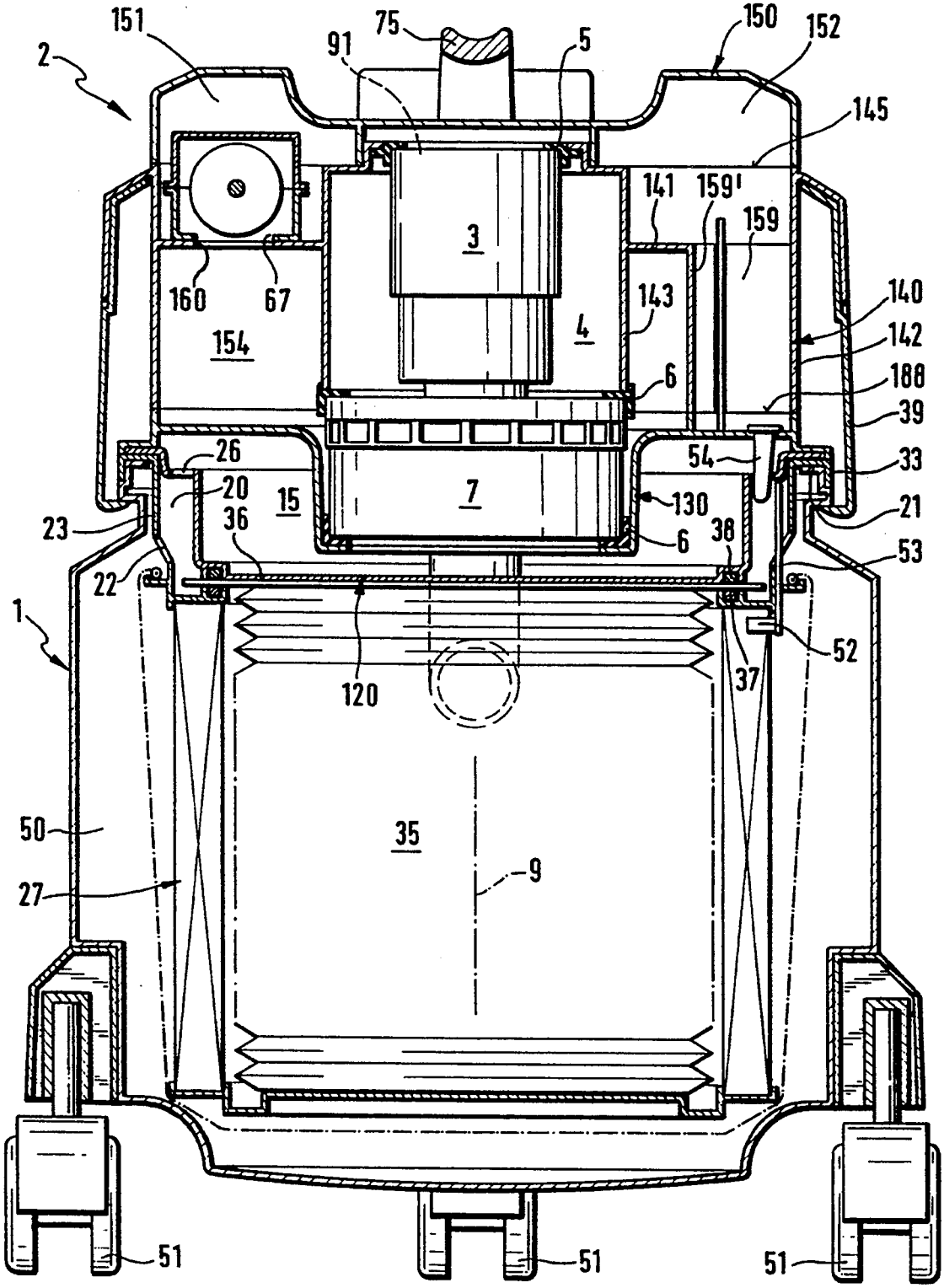
FIG. 2 is a longitudinal section through the vacuum cleaner of FIG. 1, extending transversely with respect to the handle.
Figure 4:
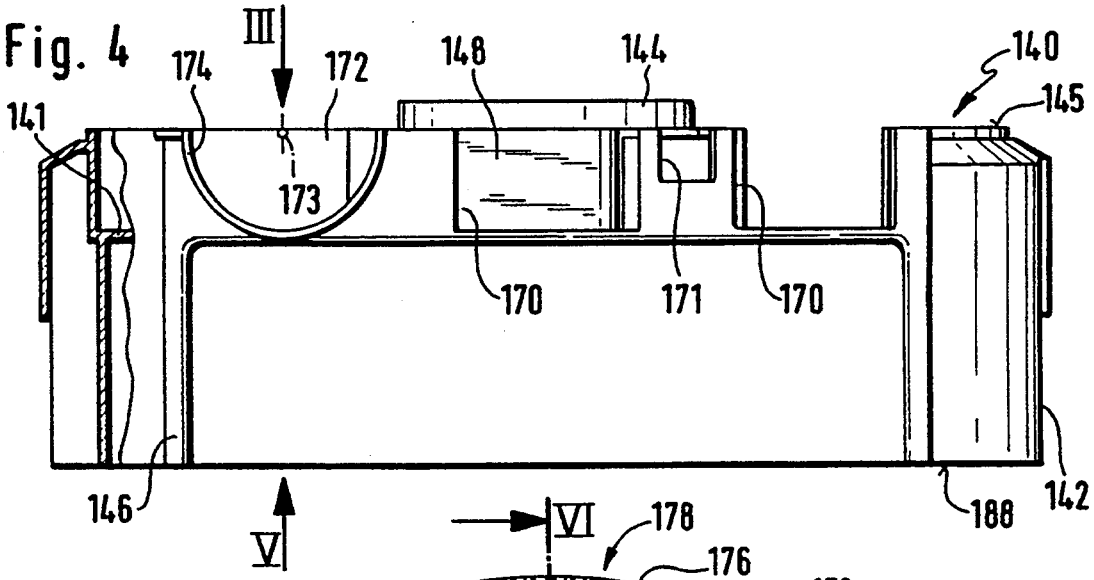
FIG. 4 is a view of the base casing in the direction of arrow VI in FIG. 3.

The vacuum cleaner illustrated in FIG. 1 in elevation and in FIG. 2 in section transversely to an upper handle 75, consists in its basic construction of a cylindrical container as the receptacle 1, which is closed by an attached cover 2. The receptacle 1 serves, when used as a "dry" vacuum cleaner, for receiving the dirt sucked up and, when used as a "wet" vacuum cleaner as a receiving container for the dirty liquid sucked up.

Provided in the cover 2 are the drive unit for the vacuum cleaner, all electrical control devices, all electrical connections, and all connections for the vacuum air stream. As can be seen in particular from the sectional view of FIG. 2, the cover 2 is composed of four parts, namely a bottom plate 120, an intermediate plate 130, a base casing 140 as well as an upper, cover-like closure plate 150 to which the handle 75 is attached.

The base casing 140, illustrated in FIG. 2 in section transverse with respect to the handle 75, is illustrated in detail in FIGS. 3 to 6. It consists of a circular base plate 141. Its center lies on the vertical longitudinal axis 9 (FIGS. 1, 2) of the vacuum cleaner. An outer wall 142 projects beyond the base plate 141 in both axial directions, so that the base casing 140, seen both from the closing cover 150 as well as from the intermediate plate 130, forms receiving chambers (FIG. 2). Passing through the base plate 141 is a receiving cylinder 143 which is open at both ends, the receiving cylinder 143 constructed with a stepped, reduced diameter at its end 144 facing the closure plate 150. The end 144 with the reduced diameter projects beyond the plane of separation 145 between the base casing 140 and the closure plate 150.

Figure 3:
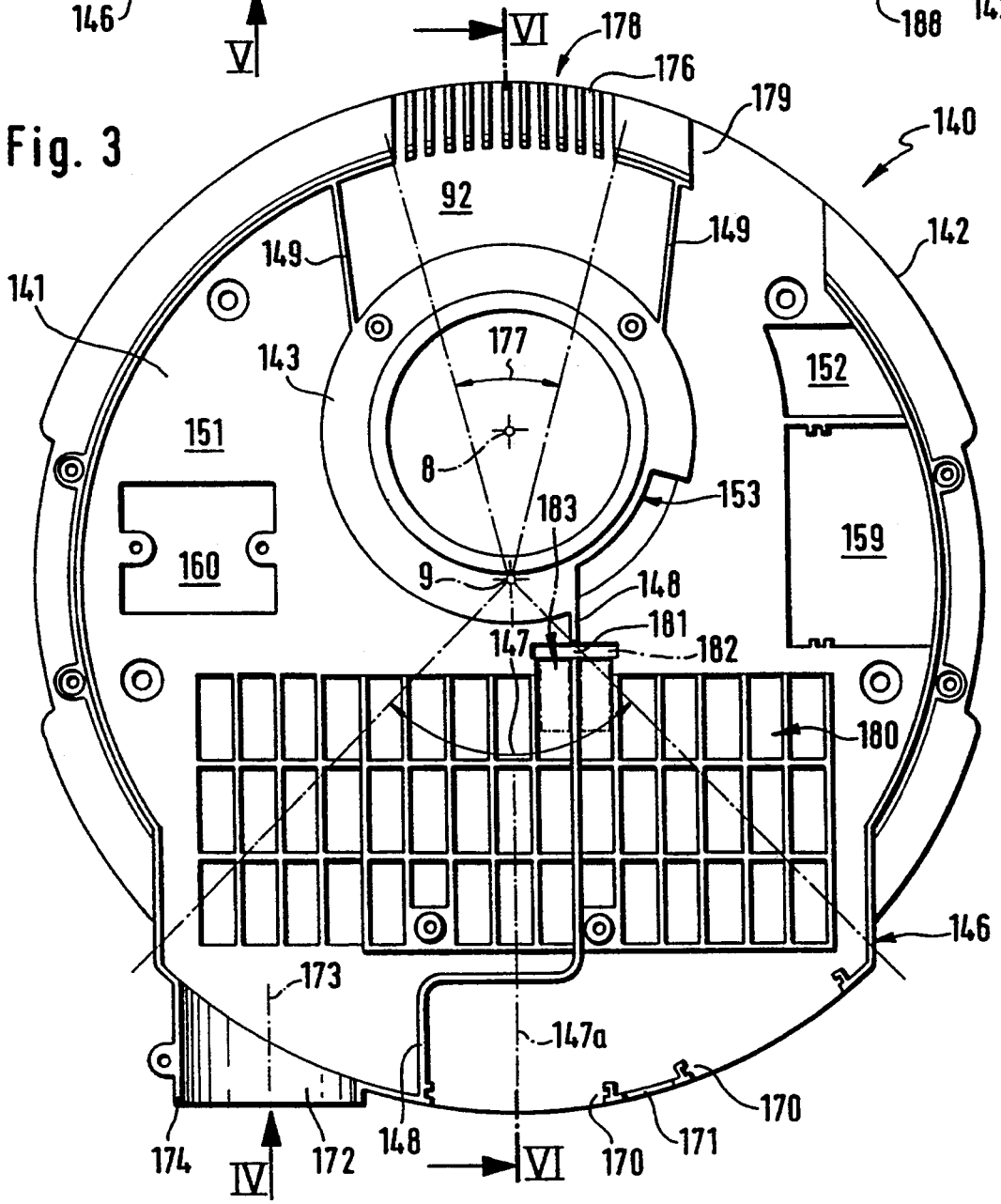
FIG. 3 is a plan view of the base casing of the cover, viewed from the closure plate.

As can be seen from the plan view according to FIG. 3, the base casing 140 has an enlarged radius over a segment angle 147 of approximately 100°, so that the base casing 140 forms a radial projection 146 over this angle 147. This radial projection 146 extends substantially over the entire height of the vacuum cleaner, is consequently also present at the receptacle, and serves in particular for correctly fitting the cover 2 to the receptacle 1 or dirt collecting devices or the like to be inserted in the receptacle 1.

On the side facing the closure plate 150, recesses 170, 171 and 172, open towards the closure plate 150, are provided in the wall section of the projection 146. A first, approximately central recess 170 serves for receiving a front plate 175 (FIG. 1), in which are located indicators for the degree of contamination of the filters positioned in the vacuum cleaner. The angle bisector **147*a* is perpendicularly to the plane formed by the recess 170, thus perpendicularly to the front plate 175 held in the recess. Provided on one side, close to the recess 170 and adjacent to the edge of the projection 146, is a further identical recess 170, which in the embodiment illustrated is closed by a facing plate. Further operating members or indicators may be positioned, if necessary, in this recess 170**.

Provided between the recesses 170 is a further recess 171 for receiving the main switch (on/off switch). The recesses 170 and 171 are substantially rectangular and open towards the closure plate 150.

Located on the other side of the recess 170, that is perpendicular to the angle bisector **147*a*, one half of a tube socket 174 is formed to provide a recess 172 in the form of a half shell open towards the closure plate 150. The longitudinal axis 173 of the tube socket 174 (FIG. 3) lies parallel to the angle bisector 147*a***.

Diametrically opposite the projection 146 the outer wall 142 has cooling air inlet slots 176. The inlet slots 176 are distributed over a segment angle 177 of approximately 30° in the wall section 178.

A recess 179 is provided beside this section 178 in the wall 142 for receiving a connecting member 161 (FIG. 13) for the electrical cord of the vacuum cleaner.

Across the diameter of the base plate 141 — partly parallel to the angle bisector **147*a* — a lateral wall 148 is provided, which extends to the side of the longitudinal central axis 9 from the receiving cylinder 143 to the projection 146 and joins the outer wall 142 between the tube socket 174 and the central recess 170. Extending in the same way from each side of the receiving cylinder 143 towards the outer wall 142 are further lateral walls 149, the lateral walls 149 being arranged such that the section 178 of the outer wall 142 provided with the cooling air inlet slots 176** is enclosed therebetween.

The lateral walls 148 and 149 as well as the axial end of the outer wall 142 facing the closure plate 150 advantageously end at a common plane, which forms the plane of separation between the base casing 140 and the closure plate 150.

Figure 8:
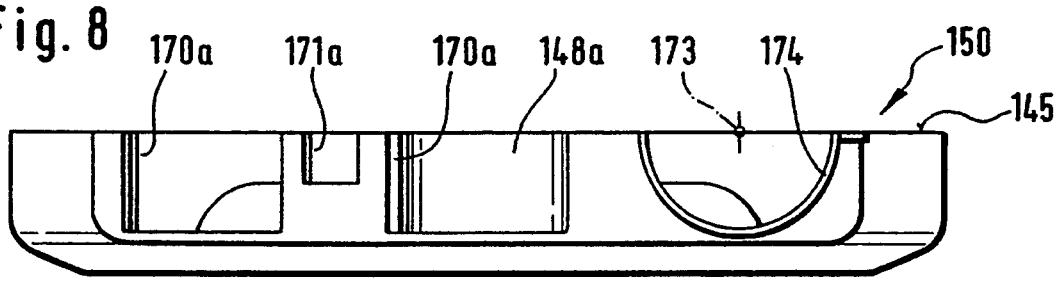
FIG. 8 is a side view of the cover viewed from the projection.
Figure 7:
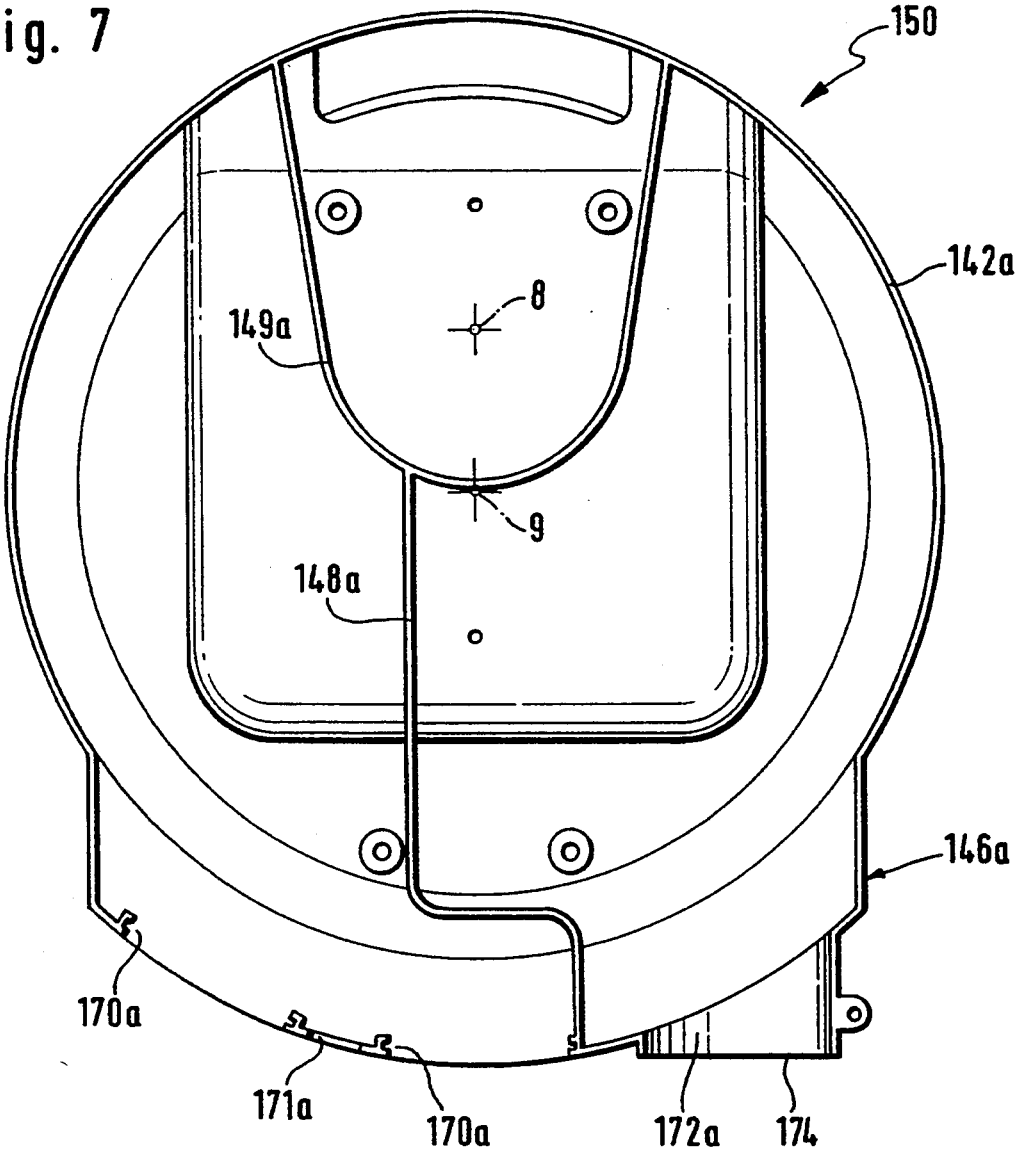
FIG. 7 is a view of the closure plate of the cover viewed from the base casing.

As can be seen from FIGS. 7 and 8, the closure plate 150 constructed in the form of a cap is provided with inner lateral walls **148*a* and 149*a*, which corresponds to the lateral walls 148 and 149 of the base casing 140. Also, the outer wall 142*a* of the closure plate 150 extends in a manner corresponding to the outer wall 142 of the base casing 140. A projection 146*a* is therefore likewise provided, in which recesses 170*a*, 171*a*** and 172*a*, corresponding to the recesses 170 to 172 in the base casing 140, are present. When the closure plate 150 is fitted on the base casing 140, on the one hand, the recesses are closed and the tube socket 174 is formed by the two recesses 172 and 172*a* in the form of half shells. The terminal edges of the walls resting one on the other in a largely air-tight manner separate an air calming chamber 151 constructed between the base casing 140 and the closure plate 150 from a cooling air exhaust chamber 152 (FIG. 2).

A cooling air inlet 160 is formed in the base plate 141 of the base casing 140, whereas a cooling air outlet 153 is located in the mantle surface or wall of the receiving cylinder 143. The motor cooling air enters the cooling air exhaust chamber 152 through the cooling air outlet 153.

Also provided in the cooling air exhaust chamber 152 is a holder 159 for electronic control members and the like. The electronic control members are thus located in the cooling air stream of the motor and their adequate cooling is guaranteed.

Located in the region of the projection 146 is a cooling air outlet grid 180, which, seen in plan view in the direction toward the base plate 141 — is substantially rectangular and extends largely over the entire width of the projection 146. The longitudinal central axis of the outlet grid 180 thus is perpendicular to the angle bisector 147*a*. The cooling air outlet grid 180 in this case is spaced with one longitudinal side at a short distance from the longitudinal central axis 9 of the vacuum cleaner. The lateral wall 148 divides the cooling air grid approximately in the ratio of 3:2, the greater surface area of the outlet grid 180 being associated with the air calming chamber 151.

Formed in the lateral wall 148 is a vertically extending slot 181 (FIG. 6), in which the holder 182 (FIG. 3) of a double forked light barrier 183 is held. The first fork of the light barrier is thus provided at the outlet grid on the side of the cooling air outlet chamber and the other fork of the light barrier is provided at the cooling air grid on the side of the air-calming chamber 151. Respectively, one arm of the forked light barrier thus lies on the side of the base plate 141 facing the closure plate 150 and the other arm of each forked light barrier lies on the side of the base plate 141 facing the intermediate plate 130, the arms on this side positioned at a distance from the base plate 141.

On the side of the base casing 140 (FIGS. 5, 6) facing the intermediate plate 130, the outer wall 142 is recessed over the angle 147 of the projection 146. For closing off the base casing 140 relative to the projection 146, a sealing wall 184 extending parallel to the inner longitudinal side of the cooling air outlet grid 180 is provided. The sealing wall 184 tightly adjoins the outer partly cylindrical wall 142 of the base casing 140. From the sealing wall 184, at the location of the peripheral ends of the projection 146, side walls 185 extend approximately parallel to the narrow sides of the cooling air outlet grid 180 and terminate at a distance x before the outer wall 142. The chamber defined between the sidewalls 185, the sealing wall 184 and the outer wall 142 thus remains open by way of the slot 186 between the sidewall 185 and the outer wall 142.

Also provided in the outer wall 142, diametrically opposite each other, are recesses 190, in which closure members constructed as clips 39 can be affixed, by which the cover 2 is fixed to the receptacle 1.

The sidewalls 185, the sealing wall 184 as well as the outer wall 142 terminate axially at a common plane, which forms the dividing plane 188 with respect to the intermediate plate 130. The end 144' of the receiving cylinder 143 is set back with respect to this dividing plane 188.

Figure 6:
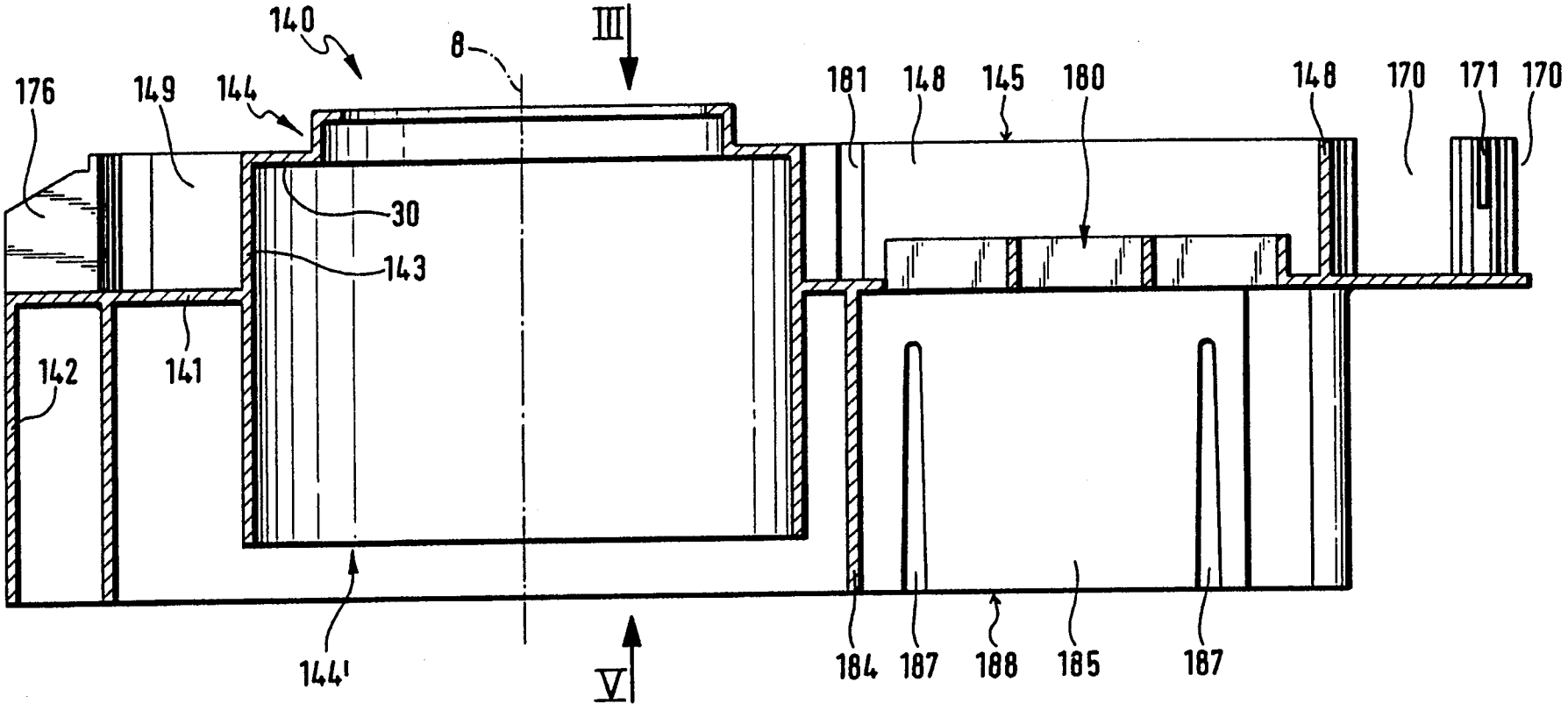
FIG. 6 is a section along the line VI—VI in FIG. 3.

As can be seen from FIG. 6, formed on the facing sides of the sidewalls 185 are guide grooves 187 extending vertically over their height, which terminate at a distance in front of the cooling air outlet grid 180 and are open towards the dividing plane 188. The guide grooves 187 advantageously taper towards their blind ends.

Figure 5:
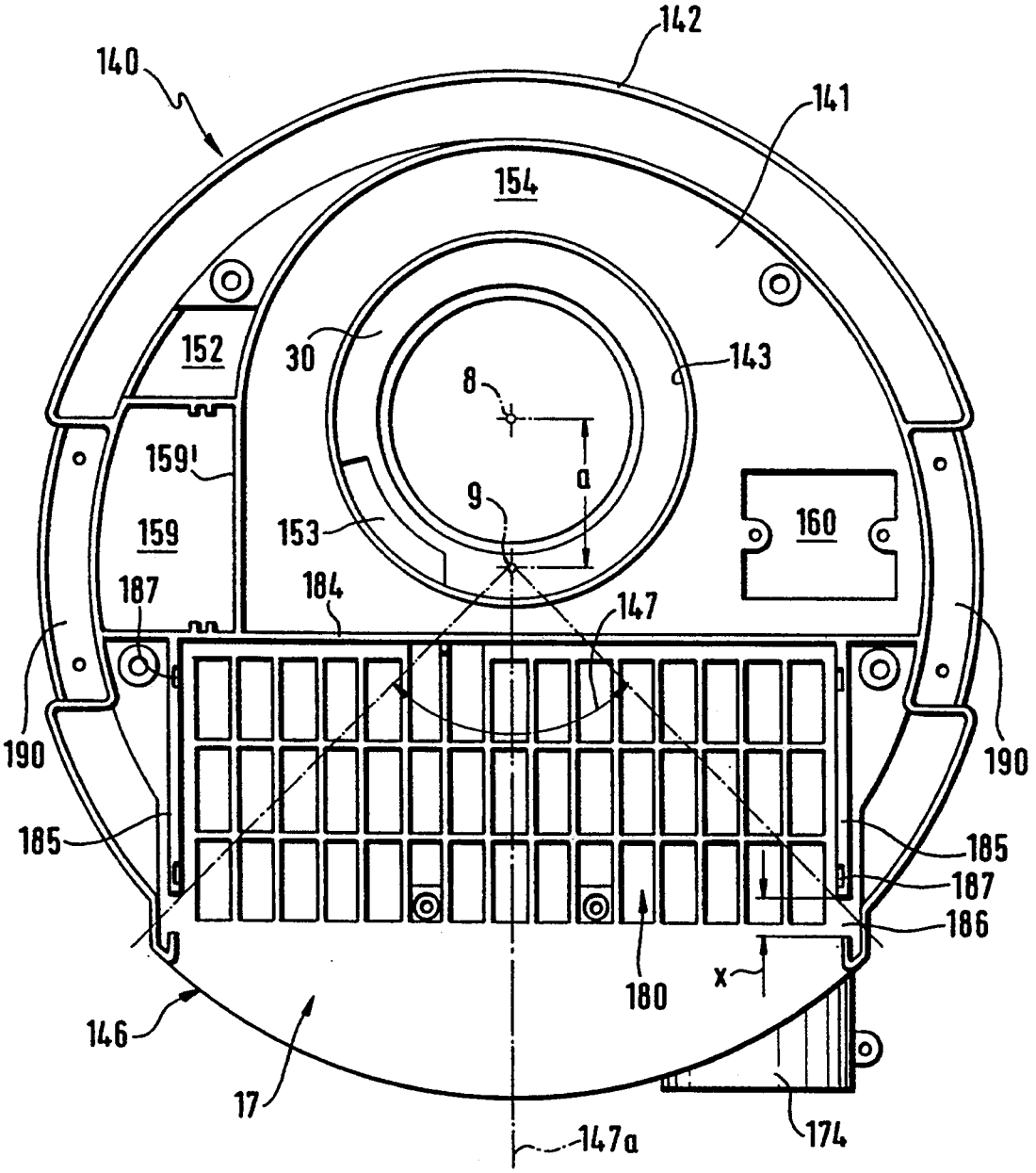
FIG. 5 is a view of the base casing in the direction of arrow V in FIG. 4.

As can be seen from FIGS. 3 and 5, the holder 159 extends over the height of the base casing 140 in the direction toward the intermediate plate 130. The inner wall 159' facing the cylinder 143 is elongated into a semi-circular shape with a transition into the outer wall 142 thus defining the air guiding chamber 154.

Figure 9:
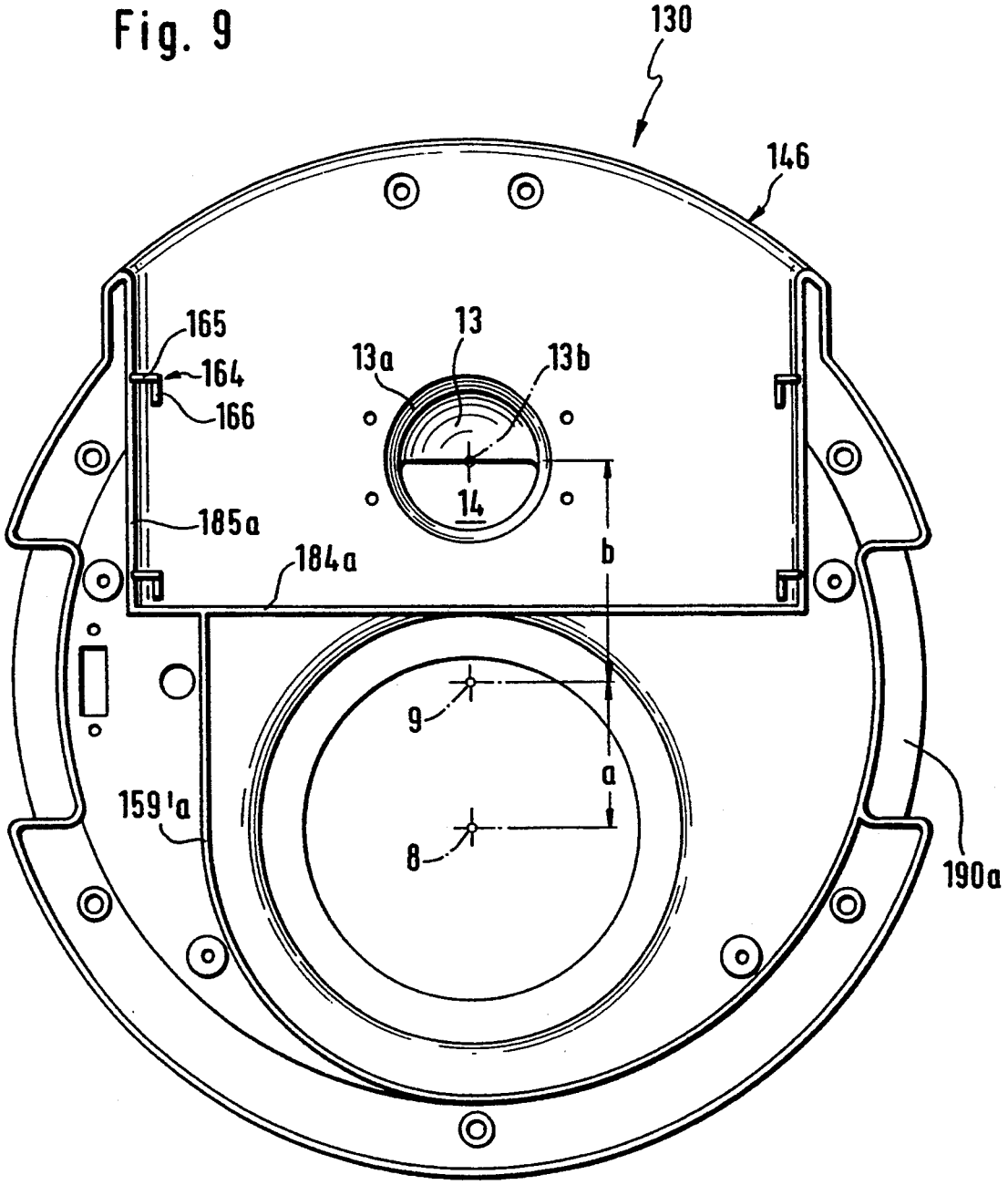
FIG. 9 is a plan view of the intermediate plate facing the base casing.
Figure 10:
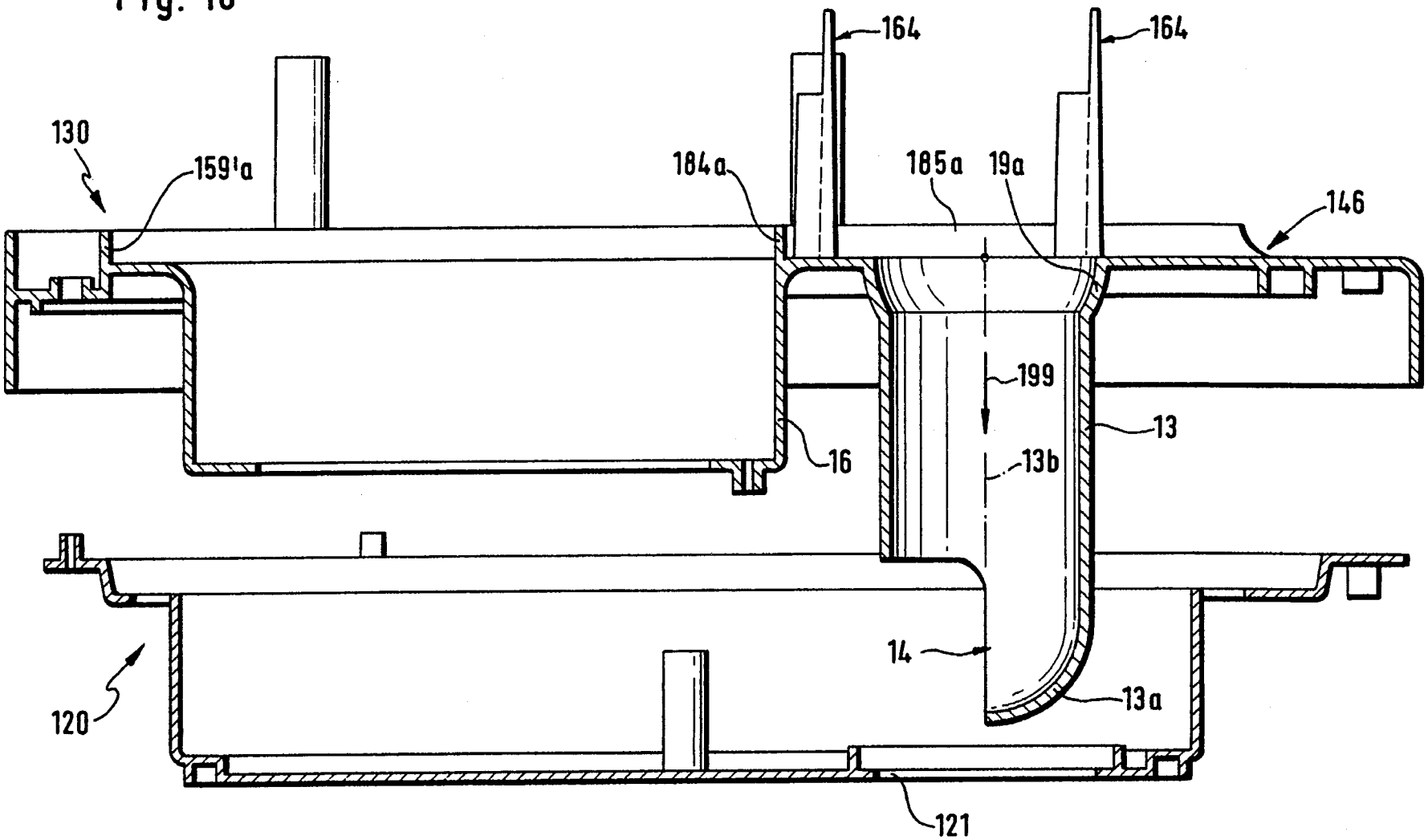
FIG. 10 is a section through the intermediate plate with coordinated base plate.

The intermediate plate 130, illustrated in FIG. 9 in plan view viewed from the base casing 40 and shown in cross-section in FIG. 10, comprises stays 184*a* and 185*a* corresponding to the sealing wall 184 and the sidewall 185, so that when the intermediate plate 130 is fitted on the base casing 140, the sidewalls 185, the sealing wall 184, the base plate 141, and the intermediate plate 130 define a passage 17, which opens radially outwardly. The air guiding chamber 154 is sealed hermetically toward the outside by a correspondingly provided stay 159'*a*.

In the region of the projection 146, the intermediate plate 130 comprises stays 164 extending perpendicularly to the plate 130, which, seen in plan view, have an angular cross-section. One leg 165 in this case engages over its entire height the associated guide groove 187 in the sealing wall 185 of the base casing 140. The other leg 166 thus faces the sealing wall 184.

The intermediate plate 130 is provided with a cylindrical, cup-shaped compartment 16 offset by a distance a with respect to the longitudinal central axis 9. The compartment 16 extends essentially axially on the side of the intermediate plate 130 remote from the base casing 140 and has a larger diameter than the receiving cylinder 143 of the base casing 140, as shown in FIG. 2.

A partial half-shell 19*a* of a ball-and-socket joint 19 is constructed in the region of the intermediate plate 130 that is opposite the air outlet grid 180. The half shell 19*a* is positioned at the same distance between the sealing wall 185 or the stays 185*a* and has a spacing b from the longitudinal central axis 9. Adjoining the partial half-shell 19*a* is an inlet channel 13 with an outlet opening 14 that faces the longitudinal central axis 9. This is achieved by closing off the free end the inlet channel 13 with a spherical partial shell 13*a*, due to which in the region of the outlet opening 14 air flowing in the direction of arrow 199 in the longitudinal direction of the inlet channel 13 is deflected slightly obliquely towards the base of the receptacle 1 approximately in the direction of the longitudinal central axis 9 of the vacuum cleaner.

The bottom plate 120 of the cover 2 is fitted on the intermediate plate 130, thereby defining a suction chamber 15 between the bottom plate 120 and the intermediate plate 130. The inlet channel 13 passes through an opening 121 in the base plate 120. A sealing ring, in particular a soft sealing ring, is advantageously fitted to the projecting end of the inlet channel 13 and air-tightly seals the gap between the base plate 120 and the inlet channel 13.

Figure 11:
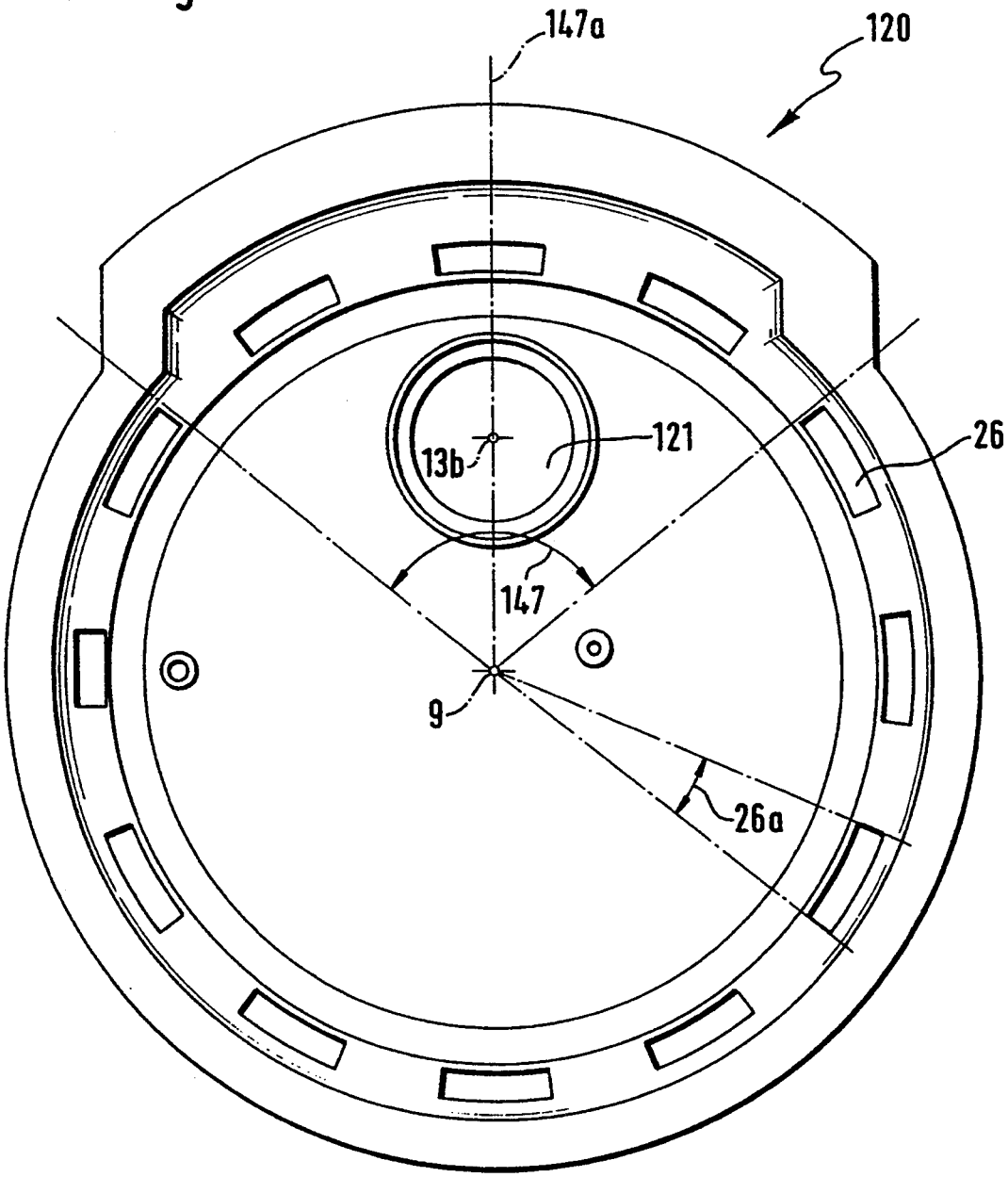
FIG. 11 is a plan view of the base plate according to FIG. 10.

As can be seen from the plan view according to FIG. 11, the bottom plate 120, its shape corresponding basically to the intermediate plate 130, the base casing 140, and the closure plate 150, is provided in the edge region, over its periphery, with a plurality of inlets 26, through which air may flow into the suction chamber 15. The inlets 26 extend over a segment angle 26*a* of approximately 15° and are distributed over the periphery at equidistant intervals. Advantageously, the intervals between two adjacent inlets 26 correspond to the segment angle 26*a*.

As shown in FIG. 2, the electrical drive motor 3 is located in the receiving cylinder 143 of the base casing 140, which thus serves as the motor compartment 4. The motor 3 is supported at the open end 144 of the receiving cylinder 143 on a resilient bearing ring 5, which preferably rests on the shoulder 30 of the open end 144.

At the opposite end, the motor 3 is connected to a suction fan 7, which is held in the cup-shaped compartment 16 of the intermediate plate 130. Advantageously, the suction fan 7 is supported on a resilient bearing ring 6 at the bottom of the compartment 16 or at an annular edge of the compartment. Provided on the side of the suction fan 7 facing the motor 3 is a corresponding resilient bearing ring 6, which engages over the edge of the suction fan 7 and on which the edge of the open end 144' of the receiving cylinder 143 rests. The vertical axis 8 of the drive motor 3 has a common major axis 8 with the attached suction fan 7. This axis 8 is spaced at a horizontal distance a from the vertical longitudinal central axis 9 of the vacuum cleaner (FIG. 5). In this case, the major axis 8 lies on the angle bisector 147*a*. The passage 17 of the cover 2, diametrically opposite the electric drive motor 3 relative to the longitudinal central axis 9, is open radially outwardly over the entire segment angle 147. In the direction of the longitudinal central axis 9, it has an axial height h and receives an angular, preferably rectangular, suction socket 10, to which the suction hose 11 with a cleaning tool (not shown in detail) can be connected.

The free end of the angular section 12, remote from the suction hose 11 and parallel to the longitudinal central axis 9, has a partially spherical part 25, which is positioned in the partial half-shell 19*a* provided at the bottom 18 of the passage 17. The partially spherical part 25 is fixed in position by a closure part 24 that corresponds to the partial half-shell 19*a*. The free end of the suction socket 10 or of the angular section 12 of the suction socket 10 remote from the suction hose 11 is thus mounted in a ball-and-socket joint 19 and therefore is able to rotate about the longitudinal central axis 13*b* of the inlet channel 13 that adjoins the bottom 18 of the compartment 17 and tilt within the clearance range of the suction socket 10 in the passage 17 (height h). When upon producing a vacuum an air stream flows in the direction of arrow 199, the spherical part 25 is drawn into the partial half-shell 19 due to the vacuum, so that, as a whole, the mobility of the suction socket 10 is dampened when the vacuum cleaner is in operation.

On account of the dimensions of the passage 17, the suction socket 10 is able to tilt horizontally as well as vertically about the center of the ball 19*b* due to the ball-and-socket joint 19. This has the advantage that in an operating region of a vacuum cleaning tool connected to the vacuum cleaner, determined by the tilting range of the suction socket 10, the vacuum cleaner must not be moved and thus remains stationary. On the one hand, convenient operation without the danger of the vacuum cleaner tipping over is therefore guaranteed; on the other hand, the mechanical/dynamic loading of the bearings of the motor shaft on account of the Giro effect, occurring at the time of movements of the vacuum cleaner, is reduced. The eccentric location of the drive motor 3 and of the suction fan 7 also contributes to reducing the danger of the vacuum cleaner tipping over, since the center of gravity of the drive unit lies approximately diametrically opposite the suction socket 10. Furthermore, the receptacle 1 is provided at the bottom with several rollers 51, in particular four rollers, which are positioned at equal intervals in the peripheral direction. One of the rollers 51 in this case lies exactly centrally below the passage 17, thus directly below the suction socket 10, thereby further reducing the danger of tipping over.

Figure 12:
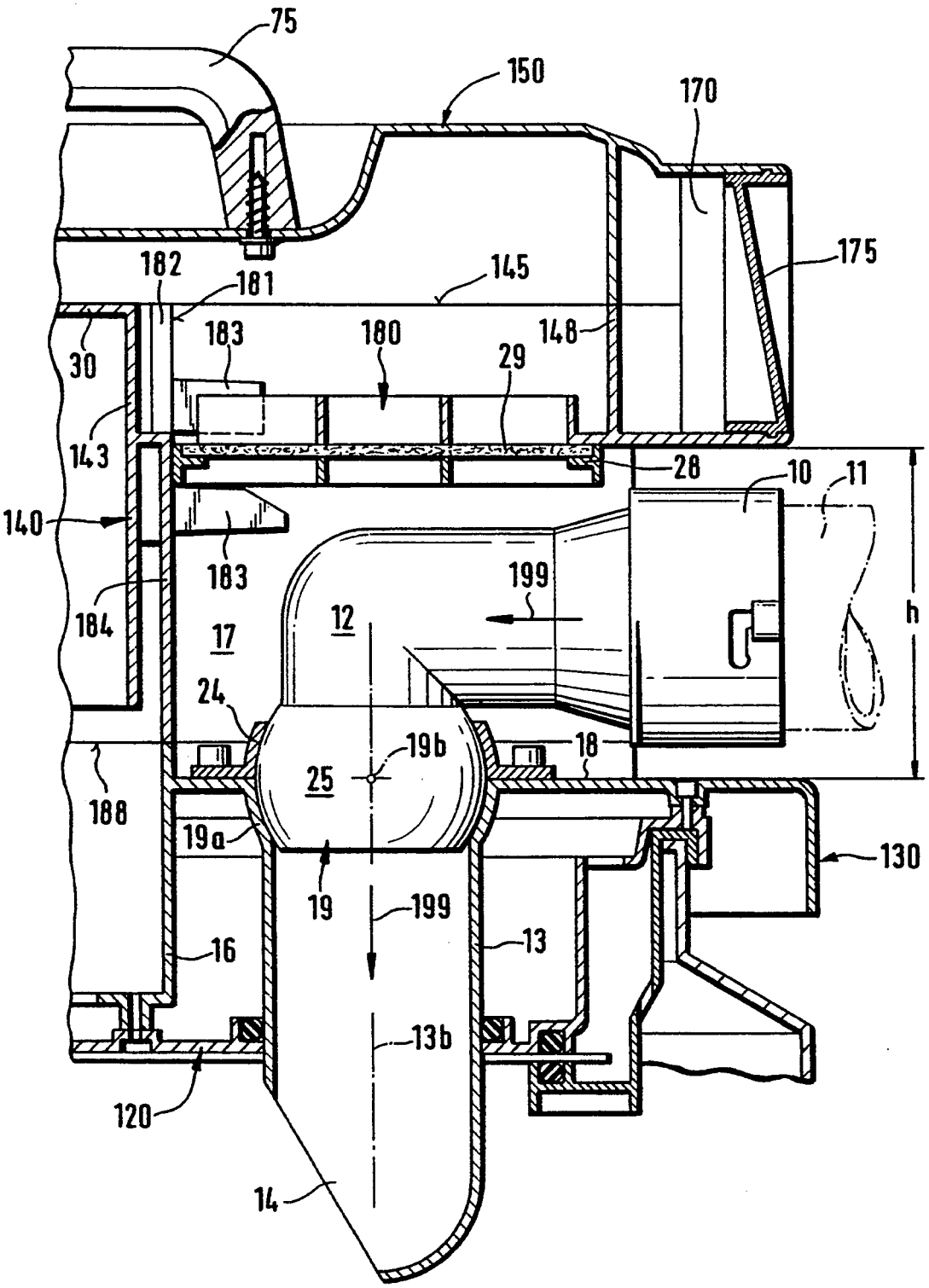
FIG. 12 is a part-sectional view of the passage of the vacuum cleaner at the level of the suction socket.

When the drive motor 3 is operating, the suction fan 7 sucks in air from the receptacle 1 via the inlets 26 and the suction chamber 15. As shown in FIG. 12, the dirt-laden intake air stream flows to the receptacle 1 by way of the suction socket 10 and is first deflected by preferably 90° in the angular section 12, so that the dirt particles entering with high kinetic energy lose their kinetic energy due to the deflection. The intake air stream flows by way of the angular section 12 into the inlet channel 13 and is again deflected by approximately 90° in order to be discharged from the outlet openings 14, due to which the dirt particles conveyed lose further energy. From the outlet opening 14, the dirt-laden intake air stream flows approximately transversely and slightly inclined with respect to the longitudinal central axis 9 into the receptacle 1, where the dirt particles carried by the intake air stream are filtered out and retained in a filter described in further detail hereafter. Due to the closure of the outlet opening 14 of the inlet channel 13 in the shape of a quarter of a sphere, it is ensured that despite the eccentric supply of the dirt-laden intake air stream, the regions of the filter directly adjacent to the inlet channel 13 are not directly impacted, so that there is no risk that particles that may still have high kinetic energy penetrate the filter wall, resulting in a great loss, possibly even complete elimination, of the filtering action.

The filter illustrated in the embodiment in FIG. 2 consists of a support ring 23, which rests on a support edge 21 of the receptacle 1. Located between the wall of the receptacle and the filter 27 is the clean air chamber 50, which is closed towards the cover 2 by the support ring 23. The support ring 23 comprises a plurality of discharge openings 22 distributed over its periphery in the edge region. The openings 22 guarantee a uniform discharge of the clean air about the periphery of the filter 27. It is thus also ensured that the filter is loaded substantially uniformly over its entire filtering surface.

The discharge openings 22 open into a throughflow chamber 20, which is formed between the support ring 23 and the bottom plate 120 of the cover. Clean air passes into the suction chamber 15 of the suction fan 7 by way of the inlets 26 provided in the edge region of the cover 2. The size and number of the discharge openings 22 in the support ring 23 appropriately correspond to the construction of the inlets 26; the plurality of discharge openings 22 or inlets 26 is arranged such that flow-technologically, a type of annular air inlet is produced, which guarantees largely uniform flow conditions over the entire periphery of the filter 27.

Figure 13:
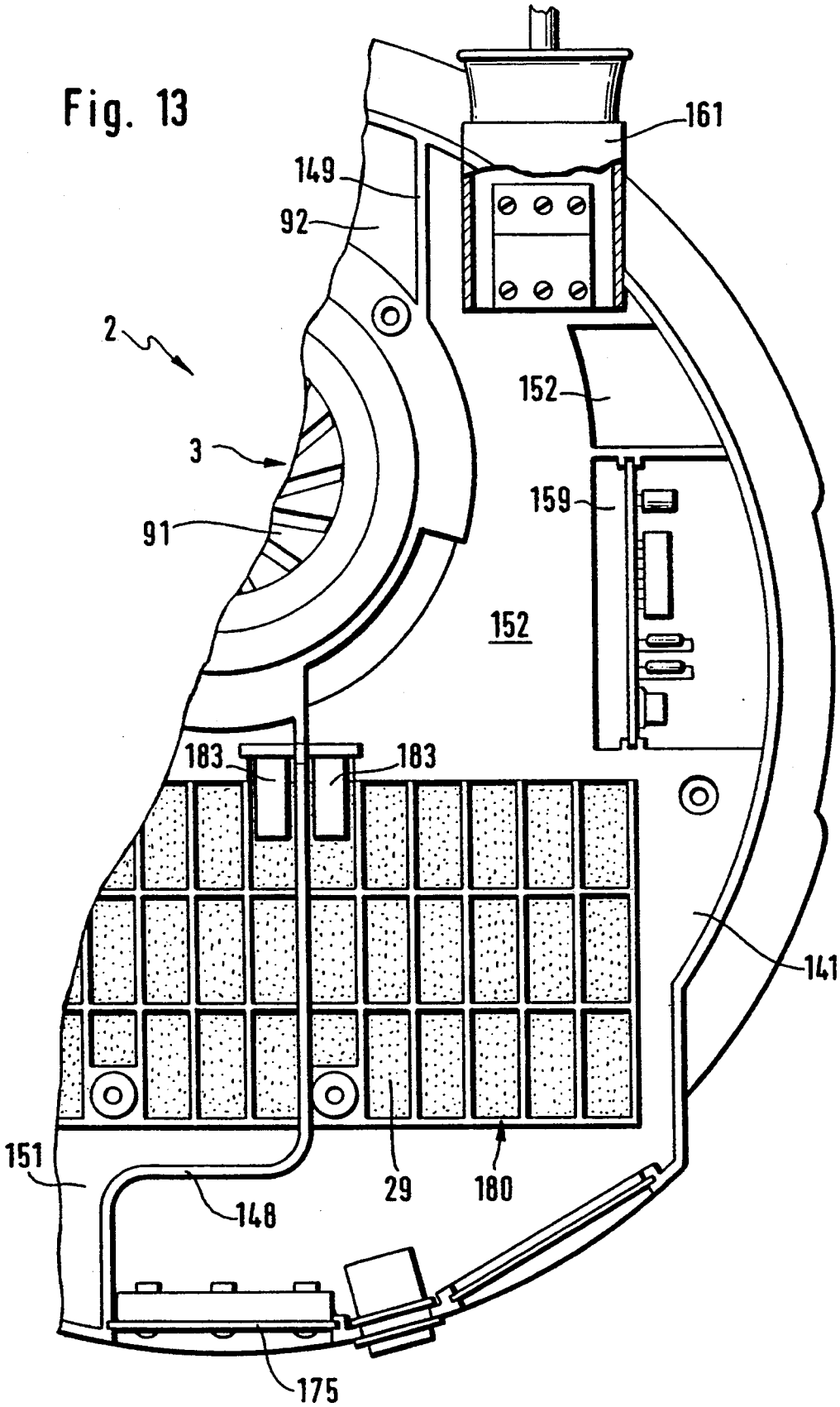
FIG. 13 is a part-sectional view of the cover providing a plan view of the exit filter.

The air stream is sucked by the suction fan 7 from the suction chamber 15 into the air guiding chamber 154 and is able to expand there. The air then flows through the air inlet opening 160 into the air calming chamber 151 and is exhausted in a diffused manner through the air outlet grid 180 and the passage 17. The air outlet grid 180 forming the lid of the passage 17 is covered by an outlet filter 29. The outlet filter 29 is a filter mat, preferably an electret filter, which is laid on a support 28. The support 28 is inserted radially into the passage 17 whereby it is guided on the free ends of the stays 164. The outlet filter 29 advantageously is positioned between the air outlet grid 180 and the support 28. The arms of the double forked light barrier 183 in this case engage through the outlet filter 29, thus providing the possibility of monitoring the dirt collected on the outlet filter 29. FIG. 13 shows the position of the double forked light barrier 183 inside the cover 2, and FIG. 12 shows the position of the double forked light barrier 183 in the region of the passage 17. FIG. 13 also shows clearly that both the loading with dirt of the filter mat section filtering the exhaust air stream is monitored as well as the filter mat section filtering the cooling air flow from the cooling air outlet chamber 152.

Figure 14:
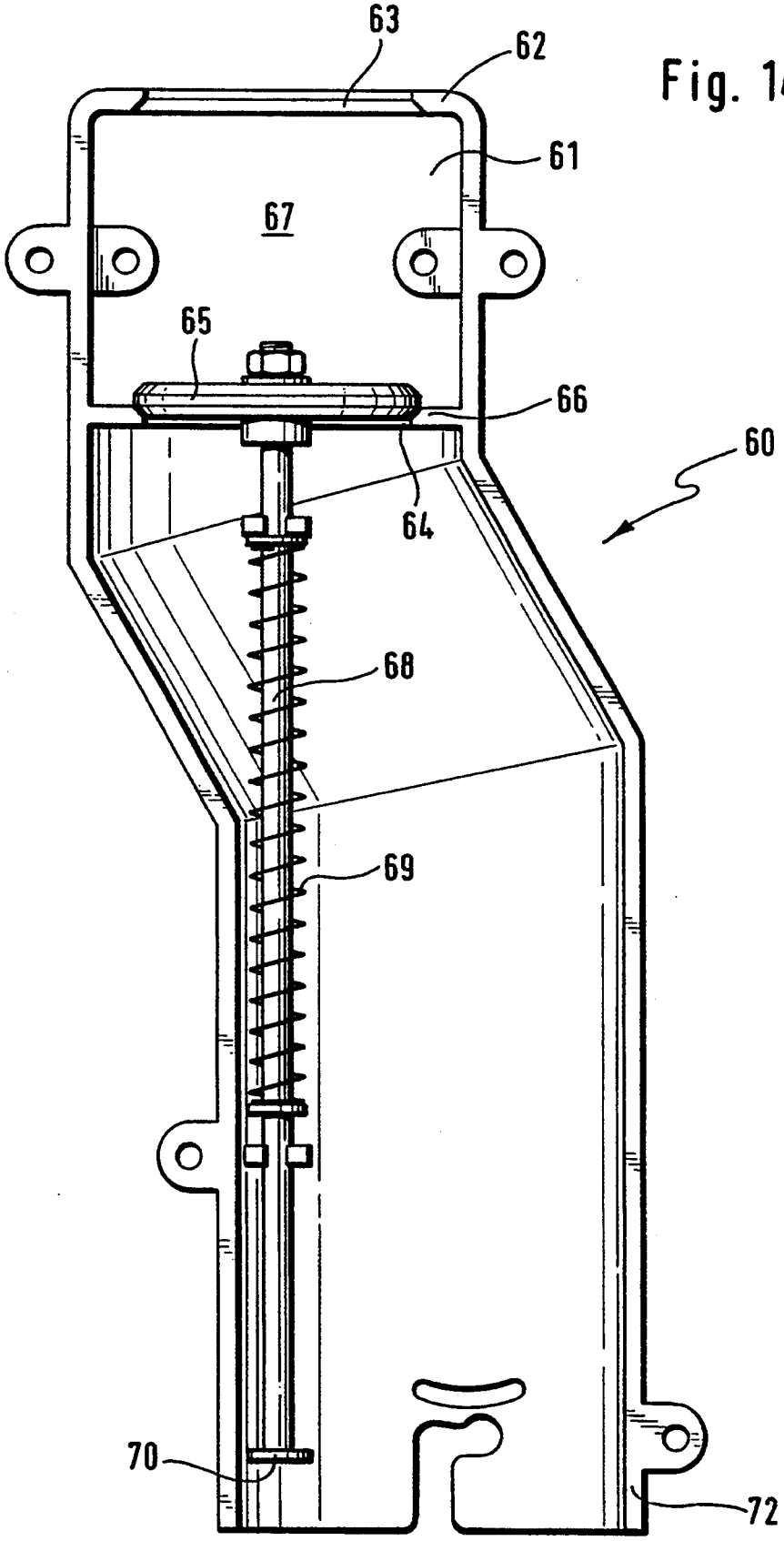
FIG. 14 is a section of the cover with its exhaust socket.

Not only can the intake air stream be blown out by way of the air calming chamber 151 in a diffused manner through the air outlet grid 180 and the passage 17, but also in a directed manner by way of an air exhaust socket 60 (FIG. 14). The air exhaust socket 60 having a valve chamber 61 with an opening 67 at the bottom (FIG. 2) is located above the air inlet opening 160 in the base plate 141 of the base casing 140. The air exhaust socket 60 discharges the air stream coming from the air-guiding chamber 154 directly through the valve chamber 6 and through the recess 172 constructed as a tube socket 174 to the exterior. In two opposite walls 62 and 66 of the valve chamber 61 throughflow openings 63 and 64 are provided, which can be closed off alternately by a valve plate 65. The valve plate 65 can be actuated by a valve rod 68, which is guided in the longitudinal direction of the air exhaust socket 60 and lies with its front end 70 within an area of the connecting collar 72 of the air exhaust socket 60. The connecting collar 72 is connected in an air-tight in the tube socket 174, preferably by inserting a gasket. An air exhaust hose is inserted into the connecting collar 72.

If no air exhaust hose is connected to the air exhaust socket 60, the valve rod 68 is moved by the force of the spring 69 into the position shown in FIG. 14. The valve plate 65 closes off the opening 64, due to which the exhaust air stream may pass from the air guiding chamber 154 by way of the opening 63 into the air calming chamber 151 and escapes in a diffused manner through the air outlet grid 180. When an air exhaust hose is inserted into the connecting collar 72 of the air exhaust socket 60 and secured in the manner of a bayonet closure, the forward end face of the air exhaust hose moves the valve rod 68 against the force of the spring 69, so that the valve plate 65 closes off the opening 63 and the exhaust air escapes from the air guiding chamber 154 directly through the opening 64 into the air exhaust socket 60.

The cooling air stream for the motor 3 is produced by a cooling air fan 91, which is located on the end of the motor shaft facing the closure plate 150 in the opening of the end 144 of the receiving cylinder 143. It sucks cooling air from the cooling air chamber 92, defined between the lateral walls 149 (FIG. 3), the stays **149*a* (FIG. 6), the receiving cylinder 143, the base plate 141, and the closure plate 150 to the motor 3 in the receiving cylinder 143, from which the now heated cooling air escapes via an opening 153 into the cooling air exhaust chamber 152 in order to exit in a diffused manner through the air outlet grid 180. Cool fresh air flows into the cooling air chamber 92 through the cooling air inlet slots 176 (FIG. 3). The cooling air stream is thus produced and guided separately from the intake air stream and any carbon dust or the like which is carried along is removed by the surface of the outlet filter 29**.

The vacuum cleaner according to the invention can be operated with different filter inserts both as a "dry" vacuum cleaner for solids or also as a "wet" vacuum cleaner for liquids.

In the embodiment illustrated (see in particular FIG. 2), the filter 27 is suspended in the receptacle 1. The support ring 23 comprises a U-shaped edge 33, by which the support edge 21 of the receptacle 1 is overlapped. A filter cylinder 31 may be arranged on an inner retaining ring 34, which is constructed with a smaller diameter than the U-shaped edge 33. The filter cylinder 31 expediently consists of a perforated wall 32. Suspended in this filter cylinder 31 is an exchangeable filter bag 35, which has horizontal folds in the manner of a so-called accordion fold. The end ring 36 of the filter bag 35 rests on a sealing ring 37, which is positioned in the retaining ring 34. As shown in FIG. 2, a further sealing ring 38 is provided in the bottom plate 120 opposite the sealing ring 37, so that when the cover 2 is placed on the receptacle (FIG. 2), the end ring 36 is held in an air-tight manner between the two sealing rings 37 and 38. The cover 2 is held on the receptacle 1 by two clips 39 arranged diametrically opposite each other and ensuring accurate and air-tight fixation of the cover 2 to the receptacle 1. In this case the clips 39 engage below the support edge 21.

Figure 15:
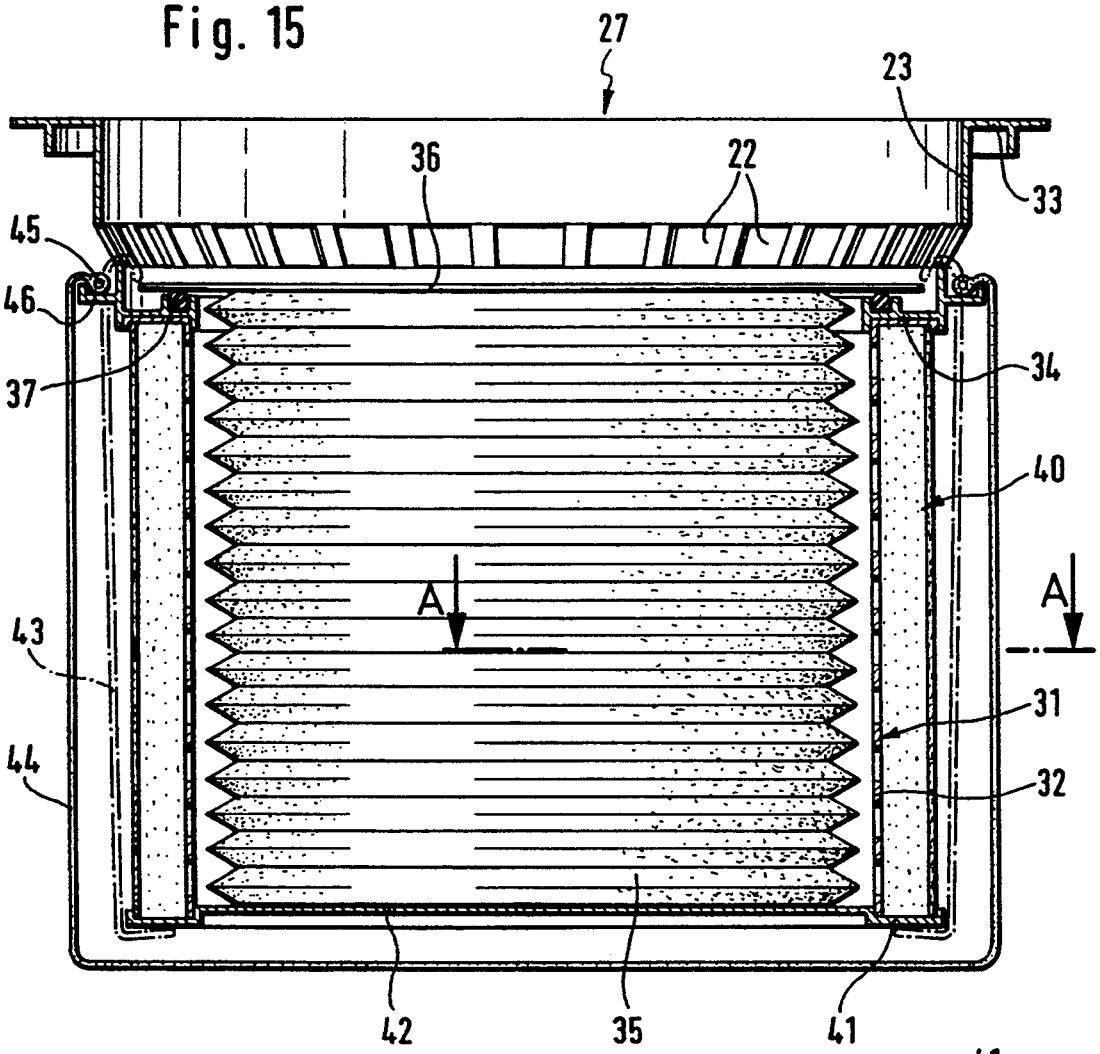
FIG. 15 is a section through one of the filter elements.
Figure 16:
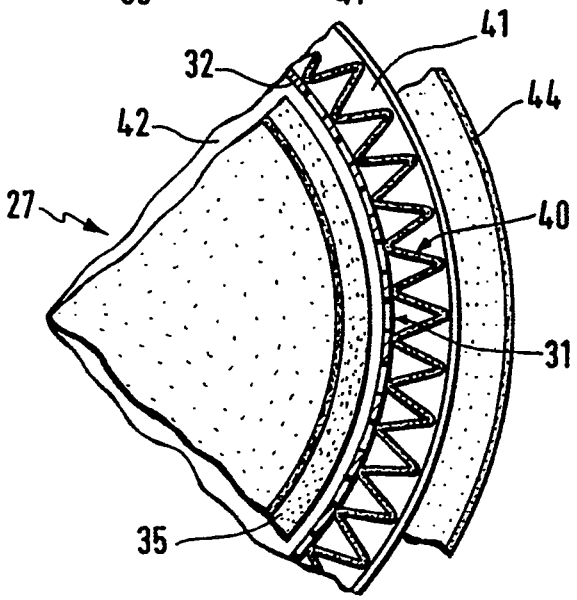
FIG. 16 is a part-sectional view of the filter element according to arrow A in FIG. 15.
Figure 17:
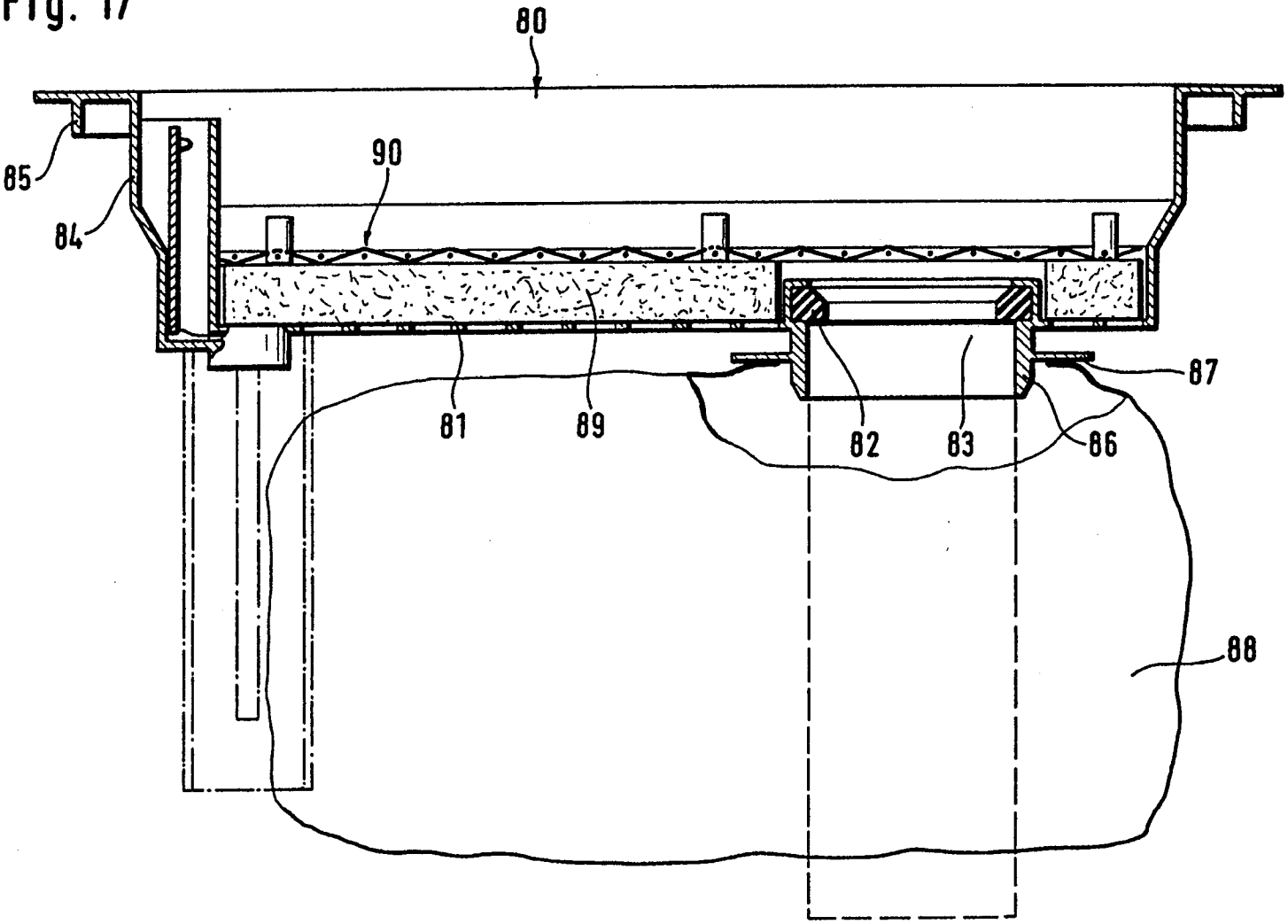
FIG. 17 is a section of a further filter element.

The filter illustrated in FIG. 15 can be supplemented by a further filter surrounding the filter cylinder 31. This further filter is constructed as a so-called filter cartridge 40 with vertical folds (FIG. 16) parallel to the longitudinal central axis. At its front end facing the retaining ring 34, the filter cartridge 40 is supported on the retaining ring 34 itself and at the opposite end is retained by the projecting edge 41 of a filter end plate 42. The filter end plate 42 can be secured axially on the support ring 23 by clips 43, so that an inner filter cylinder 31 is dispensable.

In order to achieve high dirt retention, it may be appropriate to position the filter cylinder 31 with the filter cartridge 40 surrounding it and the filter bag 35 suspended in the filter cylinder 31 in a third filter, which in the shown embodiment is constructed as a filter bag 44. Advantageously, a filter bag 44 of this type is fixed to an outer angle ring 46 for example by a pull cord 45. The outer angular ring 46 may be fixed, for example, to the outer side of the support ring 23 facing the wall of the receiving drum. Filtering is thus achieved with a high degree of retention even of the smallest particles of dust.

In a further development of the invention, a control device is located in the cover 2, which automatically stops the vacuum cleaner in the case of a correspondingly high loading of dirt of a filter in the receptacle 1. Thus, as shown in FIG. 2, by means of a further forked light barrier 52, a vertical fold of the filter cartridge 40 is monitored. The circuit board 53 supporting the forked light barrier 52 has contact points at its end facing the cover 2, against which contact points contact springs bear when the cover 2 is attached. The contact springs are arranged, for example, in a corresponding contact pin 54, which projects through the intermediate plate 130 and is attached to the bottom of the holder 159. The electronic circuits forming the control device, mounted on a circuit board, are inserted into the holder 159. If the folds of the filter cartridge which are monitored, become clogged with dirt, the passage of light to the forked light barrier is reduced, whereupon the control device responds and switches off the motor 3 and thus the vacuum cleaner. The state of the filter is indicated optically on the front plate 175 (FIG. 1) in the cover 2 of the housing. The outlet filter 29 is monitored in the same way by the double forked light barrier 183.

In a simple embodiment, in place of the filter 27 with the filter cylinder 31, a filter shell can be inserted in the receptacle 1, which due to a retaining ring 84 is provided with a U-shaped edge 85 engaging over the edge of the receptacle 1. The base 81 of the filter shell 80 has a smaller diameter than the overlapping edge 85 and is constructed in the manner of a sieve. The base 81 has a passage 83 for the passage of the inlet channel 13, which is equipped with a sealing ring 82, which engages hermetically around the projecting inlet channel 13. Adjoining the passage 83 is a socket 86 arranged in the receptacle, which socket is preferably constructed in one piece with the base 81. The socket 86 comprises an outer annular flange 87, which serves for the mounting of a filter bag 88. In the embodiment illustrated, a filter mat 89 is placed on the base 81, which mat is secured by a retaining grid 90 located thereabove. The filter mat 81 is preferably constructed as an electret filter and serves for filtering out particles of dust, which pass through the filter bag 88. The filter mat 81 can also advantageously be constructed as an odor-absorbing filter.

When the filter bag 88 is omitted and the filter shell 80 is employed, the vacuum cleaner according to the invention can be used as a "wet" vacuum cleaner. In order to monitor the filling level and to guarantee a timely switching-off of the cleaner the socket 86, as shown in broken line in FIG. 17, may be extended and contain a float arrangement, which closes an electrical contact when the full state is reached. The transmission of the electrical contact signal may take place with contacts and contact springs according to the transmission of the signals from the forked light barrier 52 (FIG. 2).

The present invention is, of course, in no way restricted to the specific disclosure of the specification and drawings, but also encompasses any modifications within the scope of the appended claims.

What is claimed is:

1. A vacuum cleaner comprising:

a receptacle having an outer wall and a suction socket;

a cover for closing said receptacle;

a drive motor connected to said cover;

a suction fan, producing an air stream that is guided via said suction socket into said receptacle and removed from said receptacle, connected to said cover;

a suction chamber having a chamber wall, said suction chamber connected between said suction fan and said receptacle and extending substantially over the entire cross-section of said receptacle;

said chamber wall of said suction chamber having a plurality of inlets in close proximity to said outer wall of said receptacle, said inlets opening into said suction chamber and arranged next to one another over a circumference of said chamber wall such that said inlets form an annular air inlet;

said suction socket having an inlet channel;

said inlet channel spaced at a distance from the central longitudinal axis of said vacuum cleaner;

said inlet channel traversing said suction chamber and extending into said receptacle substantially parallel to the central longitudinal axis; and said inlet channel having an outlet facing the central longitudinal axis.

2. A vacuum cleaner according to claim 1, wherein said outlet is slightly slanted relative to the central longitudinal axis.

3. A vacuum cleaner according to claim 1, wherein said cover comprises a bottom plate and an intermediate plate, with said suction chamber being formed between said bottom plate and said intermediate plate.

4. A vacuum cleaner according to claim 3, wherein said bottom plate is cup-shaped and has an upper, radially outwardly oriented ring, said upper, radially outwardly oriented ring having said inlets.

5. A vacuum cleaner according to claim 3, further comprising a radially outwardly open passage with a bottom, wherein said intermediate plate forms said bottom of said passage, and wherein said suction socket further comprises an angular piece movably connected within said passage, said angular piece connected to said inlet channel.

6. A vacuum cleaner according to claim 5, wherein said passage extends in a circumferential direction of said vacuum cleaner at a segment angle of substantially 90°.

7. A vacuum cleaner according to claim 5, wherein:

said cover further comprises a base casing having connected thereto a receiving cylinder;

said intermediate plate has a cup-shaped compartment;

said suction fan, in an axial direction, has a first end and a second end, said first end received in said cup-shaped compartment and said second end closing off said receiving cylinder;

said intermediate plate and said base casing enclose an air guiding chamber, said air guiding chamber at least partially surrounding said receiving cylinder and communicating with said cup-shaped compartment; and said passage is comprised of a sealing wall, arranged as a secant and sealing said passage relative to said air guiding chamber, and two sidewalls extending perpendicular to said sealing wall.

8. A vacuum cleaner according to claim 7, further comprising an air calming chamber, and wherein:

said base casing comprises a base plate;

said cover comprises lateral walls and an upper closure plate, said air calming chamber being formed between said base plate, said lateral walls and said upper closure plate; and said base plate has an air inlet opening for connecting said air calming chamber to said air guiding chamber.

9. A vacuum cleaner according to claim 8, wherein said passage has an outlet grid, and wherein said air calming chamber is connected to said outlet grid and open to the atmosphere via said outlet grid.

10. A vacuum cleaner according to claim 8, further comprising a valve chamber positioned above said air inlet opening in said air calming chamber and an air exhaust socket connected to said cover and extending radially from said cover, said valve chamber comprising a valve member for directing an air flow alternately to said air calming chamber and said air exhaust socket.

11. A vacuum cleaner according to claim 8, further comprising:

partitions perpendicularly connected to said base plate of said base casing;

a cooling air inlet chamber enclosed between said receiving cylinder and said partitions, said cooling air inlet chamber having cooling air inlet slots provided in an outer wall of said base casing;

a cooling air exhaust chamber enclosed between said base casing and said closure plate; and wherein said receiving cylinder has a bottom with a cooling air inlet and a mantle surface with a cooling air outlet, with a cooling air flow entering said vacuum cleaner through said cooling air inlet slots, flowing through said cooling air inlet into said receiving cylinder for cooling said drive motor and exiting said receiving cylinder through said cooling air outlet into said cooling air exhaust chamber.

12. A vacuum cleaner according to claim 11, wherein said passage has a top plate with an outlet grid, and wherein said cooling air exhaust chamber is connected to said outlet grid and opens to the atmosphere via said outlet grid.

13. A vacuum cleaner according to claim 12, further comprising:

a support for at least one exchangeable filter, said support radially slidable into said passage, wherein said outlet grid connected to said air calming chamber and said outlet grid connected to said cooling air exhaust chamber are covered by said exchangeable filter;

a double forked light barrier, said filter positioned between said light barrier; and a control, for switching said drive motor, connected to said double forked light barrier.

14. A vacuum cleaner according to claim 3, wherein said inlet channel and said intermediate plate are a single unitary part and wherein said inlet channel penetrates said bottom plate in an air-tight manner.

15. A vacuum cleaner according to claim 3 further comprising:

a throughflow chamber and a support ring for a filter, said support ring resting in said receptacle, with said throughflow chamber positioned between said bottom plate and said support ring;

a grate with a filter mat, said grate supported on said support ring, and said grate and said filter mat penetrated by said inlet channel; and a fastening device for an inner dust filter bag, said inlet channel extending into said dust filter bag, said fastening device connected to a side of said grate facing said receptacle.

16. A vacuum cleaner according to claim 15, further comprising a support cylinder supported on said support ring, with an end of said support cylinder facing said cover being closed.

17. A vacuum cleaner according to claim 15, further comprising a cover plate supported on said support ring, said inlet channel penetrating said cover plate in an air-tight manner, and further comprising a dust filter supported by said cover plate.

18. A vacuum cleaner according to claim 17, wherein said dust filter is in the form of accordion folds.

19. A vacuum cleaner according to claim 15, further comprising an outer cylindrical folded filter with upright folds, said folded filter supported by said support ring.

20. A vacuum cleaner according to claim 19, further comprising an outer filter bag supported by said support ring, said folded filter enclosed by said filter bag.

* * * * *